United States Patent [19]

Katsuta et al.

[11] Patent Number: 4,856,407

[45] Date of Patent: Aug. 15, 1989

[54] ACTION MECHANISM FOR A KEYBOARD OF AN ELECTRONIC PIANO

[75] Inventors: Masanori Katsuta; Tsutomu Yamaguchi, both of Shizuoka, Japan

[73] Assignee: Kabushiki Kaisha Kawai Gakki Seisakusho, Shizuoka, Japan

[21] Appl. No.: 242,575

[22] Filed: Sep. 12, 1988

[30] Foreign Application Priority Data

Sep. 18, 1987 [JP] Japan ..... 62-143570[U]

[51] Int. Cl.[4] ..... G10C 3/12

[52] U.S. Cl. ..... 84/439

[58] Field of Search ..... 84/439, 440, 433, 434–436

[56] References Cited

U.S. PATENT DOCUMENTS 4,375,179 3/1983 Schwartz et al. ..... 84/439

FOREIGN PATENT DOCUMENTS 19729 2/1979 Japan ..... 84/433

*Primary Examiner*—L. T. Hix

*Assistant Examiner*—Brian W. Brown

*Attorney, Agent, or Firm*—Sughrue, Mion, Zinn, Macpeak and Seas

[57] ABSTRACT

An action mechanism for a keyboard of an electronic piano which is capable of producing a touch that is nearly equal to that of an ordinary piano. The action mechanism comprises an action spring including a friction spring portion to produce a friction force which always opposes depression and restoring movements of key members.

4 Claims, 4 Drawing Sheets

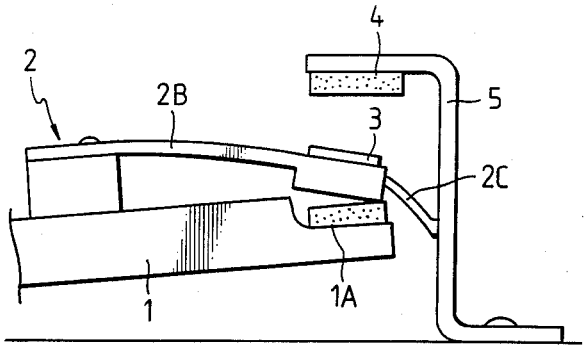
FIG. 9
FIG. 10
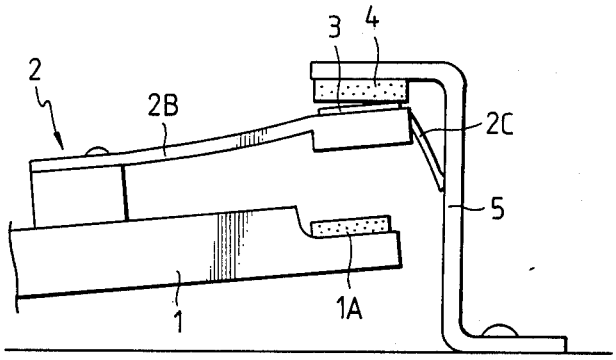
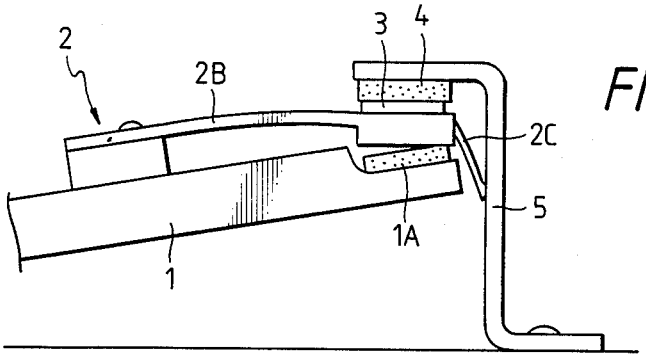
FIG. 11

ACTION MECHANISM FOR A KEYBOARD OF AN ELECTRONIC PIANO

BACKGROUND OF THE INVENTION

1. Field of the Invention

The present invention relates to an action mechanism for a keyboard o an electronic piano, which is adapted to have a touch similar to that of an ordinary piano.

2. Description of Prior Art

As illustrated in FIG. 1 which is a side view of a conventional action mechanism for a keyboard of an electronic piano, a key member 1 is supported by a balance rail 6 in such a manner that the key member 1 is allowed to move seesaw with respect to the balance rail 6. The key member 1 is provided with a counter weight 3 at one free end (rear end) thereof so as to apply reaction force to the key member 1 upon depression of the key member 1, whereby the electronic piano is designed to have a touch similar to that of an ordinary piano during playing.

Significant features of a touch of the ordinary piano as natural instruments reside in that:

there occurs a reaction force which acts to fingers of a player upon depression of key members, the reaction force being classified to an impact force when the fingers of player touch the key members and a reaction force generated when a hammer of the action mechanism moves with a delay to the depression movement of the key members;

the reaction force of the hammer described hereinabove varies in response to strength in the depression of key members; and a static force of key members shows hysteresis characteristic in one stroke including movements in depression and restoring directions.

An example of the reaction force of the hammer of the ordinary piano is shown in FIG. 2 and an example of the hysteresis characteristic is shown in FIG. 3.

In FIG. 2, a horizontal axis plots the movement length (stroke) of the key member upon depression thereof, and a vertical axis plots a dynamic reaction force of the hammer hitting a string, characters f, ff and fff indicating "forte", "fortissimo" and "fortissisimo".

When the depression of key member is commenced, the key member starts lifting a jack to thereby swing a hammer pad, i.e., the hammer. A summit (a point of inflection) which occurs first in each of curves shown in FIG. 2, shows a point where the dynamic reaction force of the hammer shows maximum. When the key member is further depressed, the jack releases the hammer pad at a position predetermined by the function of a regulation button, as a result of which no force actuates the hammer and then the dynamic reaction force starts decreasing from the first occurrence inflection point. In this case, the hammer swings to hit the string, and therefore the hitting causes a second inflection point in the curve of FIG. 2 to occur. Thereafter, the curves show decreasing gradually. FIG. 3 shows that the static depression force applied to the key member in the depression movement is different from that in the restoring movement.

With such an action mechanism for the keyboard of the conventional electronic piano, it may be impossible to realize a touch similar to that of an ordinary piano as natural instruments, that complies with the players' requirement.

SUMMARY OF THE INVENTION

Accordingly, an object of the present invention is to provide an action mechanism for a keyboard of an electronic piano, which is adapted to have touch characteristics similar to that of an ordinary piano as natural instruments.

The above, and other objects of the present invention is met by the provision of an action mechanism for a keyboard, which comprises a plurality of key members each supported at an approximately center position thereof by a balance rail in such a manner that the key member is allowed to move seesaw with respect to the balance rail; a stopper disposed behind the key members laterally, which is commonly used as a stopper to all of the key members; an action spring including a holder portion, an action spring portion and a friction spring portion; and a counter weight provided to the holder portion of the action spring, in which an end of the action spring portion is mounted to an upper surface of the key member at a rear position of the supporting position of the balance rail, and an end portion of the friction spring contacts with the stopper 5 slidably with being biased to the stopper.

BRIEF DESCRIPTION OF THE DRAWINGS

In the accompanying drawings:

FIGS. 9 to 11 are schematic diagrams showing side views of the action mechanism according to the present invention for the description of an operation of the present action mechanism.

DESCRIPTION OF THE PREFERRED EMBODIMENTS

Embodiments of the present invention will be described with reference to FIGS. 4 to 11.

Figure 1:
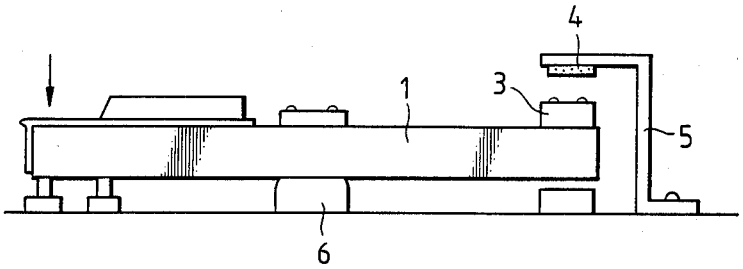
FIG. 1 PRIOR ART
FIG. 1 is a schematic diagram showing a side view of a conventional action mechanism for a keyboard of an electronic piano.
Figure 4:
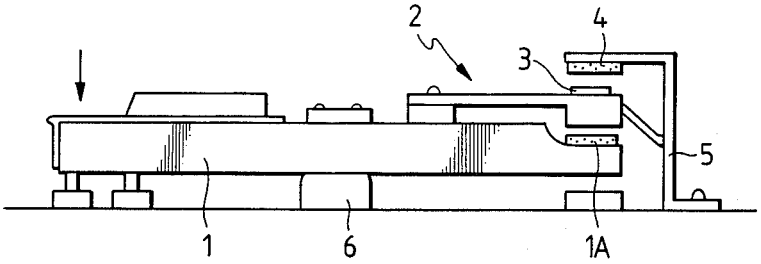
FIG. 4 is a schematic diagram showing a side view of an action mechanism for a keyboard of an electronic piano according to the present invention.
Figure 5:
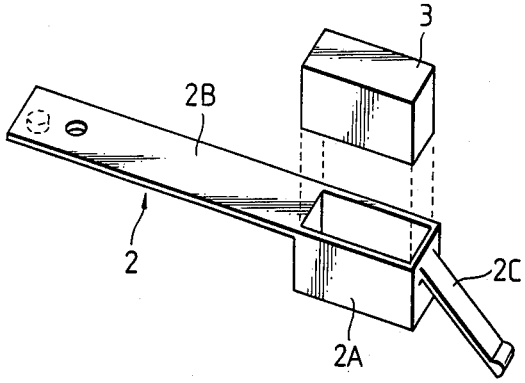
FIGS. 5 to 7 are schematic perspective views showing examples of an action spring for use in the action mechanism shown in FIG. 4, respectively.

FIG. 4 is a schematic diagram showing a first embodiment of the present invention. In FIG. 4, elements that are same as or correspond to those shown in FIG. 1 bear the same reference numerals. One end of an action spring 2 is mounted to an upper surface of the key member 1 at a rear position of the supporting position of the balance rail 6. As shown in FIG. 5, the action spring is composed of a holder portion 2A, an action spring portion 2B and a friction spring portion 2C. The holder portion 2A is shaped as a box to receive the counter weight 3 therein and the counter weight 3 is fixedly secured to the holder portion 2A by the use of either an adhesive agent or screws. Both the action spring portion 2B and the friction spring portion 2C are formed with the holder portion 2A integrally. The action spring portion 2B is provided in order to vibrate the counter weight 3 in a vertical direction whereas the friction spring portion 2C is provided in order to attenuate the vibration of counter weight 3 caused by the action spring potion 2B. A stopper 5 is arranged at a rear position of the key members 1 so as to serve as a common stopper with respect to all of the key members 1. The stopper 5 is of L-shaped so that an upper end portion thereof is positioned above the rear end portions of the key members 1 as shown in FIG. 4. The bent upper end portion of the stopper 5 is provided with an elastic member 4. Further, in order to produce hysteresis characteristics in the depression movement and the restoring movement of the key members 1, the friction spring portion 2C of the action spring 2 is arranged in such a manner that the end portion of the friction spring portion 2C is made in contact with a vertically standing portion of the stopper 5 with being biased thereto. An elastic member 1A is provided to the upper surface of the rear end portion of the key members 1 (rear to the supporting position of the balance rail 6) so as to face the elastic member 4 of the stopper 5. Due to the provision of the elastic members 1A and 4, an allowable range in the movement of the counter weight 3 is limited.

Figure 6:
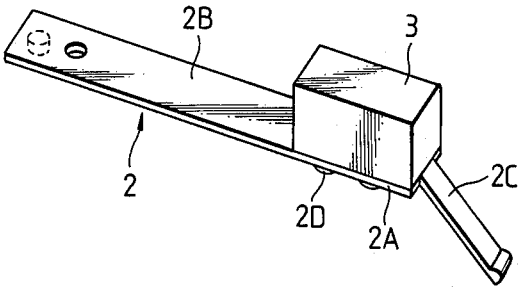
Figure 7:
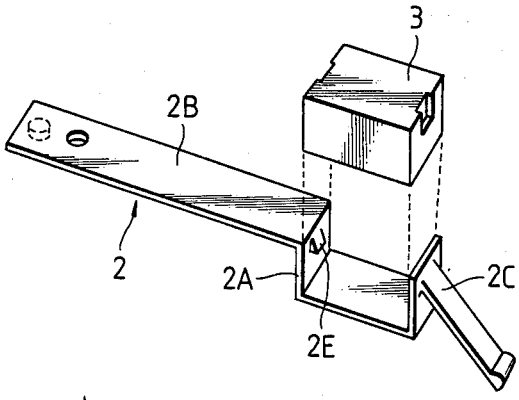

FIG. 6 is a schematic perspective view showing a second embodiment of the action mechanism according to the present invention. The second embodiment is different from the first embodiment of FIG. 5 in the shape of the holder portion 2A. As is clear from FIG. 6, the holder portion 2A is of a plate and the counter weight 3 is fixedly secured to the holder portion 2A by the used of screws 2D from the lower portion thereof. Further, holder portion 2A may be modified as shown in FIG. 7. That is, the holder portion 2A is U-shaped (concaved) to receive the counter weight 3 and further the holder portion 2A is provided with ratchets 2E at an inner surface to fix the counter weight 3.

Figure 2:
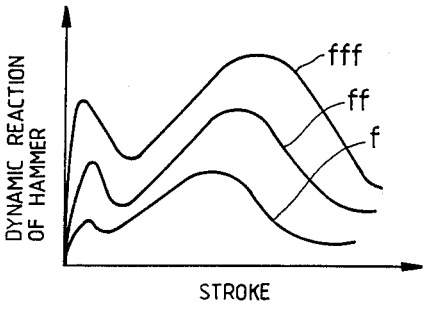
FIG. 2 is a graphical representation showing relationship between depression strength and reaction force of a hammer hitting a string of an ordinary piano.
Figure 8:
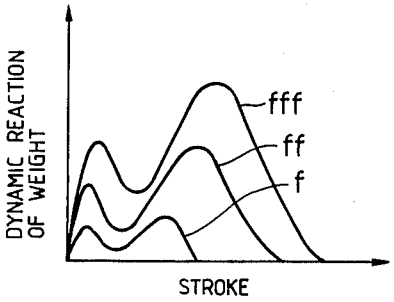
FIG. 8 is a graphical representation showing depression strength and an reaction force of a counter weight in the action mechanism according to the present invention.

FIG. 8 is a graphical representation showing a characteristic of the action mechanism according to the present invention, in which a horizontal axis plots the stroke of a key member whereas a vertical axis plots a dynamic reaction force caused by the counter weight 3. The characters f, ff and fff indicate the same conditions as those in FIG. 2. As is clear from FIGS. 2 and 8, the characteristic curves in both figures are very similar to each other. This means that the touch of the key members according to the present invention is very similar to that of the ordinary piano.

The key member 1 and the counter weight 3 move independently due to the fact that the counter weight 3 is put in a floating state by the action spring 2. The movement of action spring 2 will be described with reference to FIGS. 9 to 11 in detail.

Upon depression of the key member 1, as shown in FIG. 9, the counter weight 3 remains initially as it is, because the counter weight 3 hardly follows the depression movement of the key member 1 at once due to inertia force. As a result, the action spring 2B is bent and then the elastic member 1A provided to the rear end of the key member 1 abuts against the counter weight 3. Subsequently, the abuttment of the counter weight 3 with the elastic member 1A is released and the weight 3 moves upwardly toward the elastic member 4 of the stopper 5. The upward movement of the counter weight 3 is caused by both reaction force upon collision with the elastic member 1A and restoring force of the action spring 2B. Thereafter, the counter weight 3 collides with the elastic member 4 as shown in FIG. 10. Finally, as shown in Fig. 11, the elastic member 1A of the key member 1 collides with the bottom surface of the counter weight 3 so that the counter weight 3 is sandwiched between the elastic members 1A and 4.

Upon restoring movement of the key member 1, there may occur vibration of the counter weight 3. In this case, however, the vibration can be attenuated immediately by the friction force of the friction spring 2C acting upon the standing portion of the stopper 5.

Due to the cooperative movement of the key member 1 and the action spring 2, it is possible to obtain a touch much similar to that of the ordinary piano.

Figure 3:
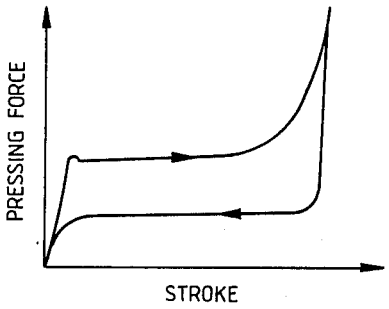
FIG. 3 is a graphical representation showing relationship between key stroke of the piano and static depression force in depression movement and restoring movement of the key member.

In summary, according to the present invention, since a friction force always opposes the movement of the key members in both depression and restoring directions by the function of the friction spring portion of an action mechanism, such a hysteresis characteristic as shown in FIG. 3 can be obtained. Consequently, it is possible to realize a touch that is very similar to that in an ordinary piano as natural instruments.

What is claimed is:

1. An action mechanism for a keyboard of an electronic piano, comprising:
   - a plurality of key members (1) each supported at an approximately center position thereof by a balance rail (6) in such a manner that said key members (1) are allowed to move seesaw with respect to said balance rail (6);
   - a member (5) disposed behind said key members laterally, which is commonly used as a stopper to all of said key members (1);
   - a plurality of action springs (2) each including a holder portion (2A), an action spring portion (2B) and a friction spring portion (2C); and
   - a counter weight (3) provided to said holder portion 2A of each of said action springs (2),
   - an end of said action spring portion (2B) being mounted to an upper surface of said key members (1) at a rear position of said supporting position of said balance rail (6), and a free end portion of said friction spring portion (2C) contacting with said stopper (5) slidably with being biased to said stopper (5).

2. The action mechanism as defined in claim 1 wherein said holder portion (2A) is shaped as a box to receive said counter weight (3).

3. The action mechanism as defined in claim 1 wherein said holder portion (2A) is of a flat plate on which said counter weight (3) is mounted.

4. The action mechanism as defined in claim 1 wherein said holder portion (2A) is U-shaped as to receive said counter weight (3) and wherein said action spring (2) further comprises a pair of ratchets provided to an inner surface of said U-shaped holder portion (2A) to fix said counter weight thereto.

* * * * *